US008800524B2

(12) United States Patent
Groleau et al.

(10) Patent No.: US 8,800,524 B2
(45) Date of Patent: Aug. 12, 2014

(54) INTAKE MANIFOLD

(75) Inventors: Wayne Groleau, Beverly Hills, MI (US); Christopher K. Clarke, Commerce Township, MI (US); David Charles Klemstine, Lake Orion, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 262 days.

(21) Appl. No.: 12/981,729

(22) Filed: Dec. 30, 2010

(65) Prior Publication Data

US 2011/0277717 A1 Nov. 17, 2011

Related U.S. Application Data

(60) Provisional application No. 61/345,357, filed on May 17, 2010.

(51) Int. Cl.
*F02M 35/10* (2006.01)

(52) U.S. Cl.
USPC ..... 123/184.21; 123/184.24; 123/184.42; 123/184.47

(58) Field of Classification Search
USPC ..... 123/184.42, 184.47, 184.53
See application file for complete search history.

(56) References Cited

U.S. PATENT DOCUMENTS

| | | | | |
|---|---|---|---|---|
| 5,063,884 | A * | 11/1991 | Rutschmann et al. | 123/184.42 |
| 6,247,655 | B1 * | 6/2001 | Filiz et al. | 239/533.2 |
| 6,622,682 | B2 * | 9/2003 | Ikuma et al. | 123/184.34 |
| 7,131,415 | B2 * | 11/2006 | Enokida et al. | 123/184.24 |
| 2005/0188940 | A1 * | 9/2005 | Huff | 123/184.42 |
| 2007/0234992 | A1 * | 10/2007 | Bloomer et al. | 123/184.47 |
| 2007/0234993 | A1 * | 10/2007 | Bloomer et al. | 123/184.47 |

* cited by examiner

*Primary Examiner* — Lindsay Low
*Assistant Examiner* — Syed O Hasan
(74) *Attorney, Agent, or Firm* — Cantor Colburn LLP

(57) ABSTRACT

An intake manifold assembly for mounting to a cylinder head and configured to deliver combustion air thereto comprises a centrally positioned zip tube having an opening for receipt of combustion air from a throttle body. First and second flow runners extend from the centrally positioned zip tube to terminate at a common intake manifold plenum for delivery of combustion air thereto. A centrally located access opening is defined between the first and second flow runners.

14 Claims, 5 Drawing Sheets

INTAKE MANIFOLD

RELATED APPLICATIONS

This application claims priority of U.S. Provisional Patent Application Ser. No. 61/345,357 filed May 17, 2010, which is incorporated herein by reference.

FIELD OF THE INVENTION

Exemplary embodiments of the present invention relate to intake systems for internal combustion engines and, more particularly, to a compact and fluidly efficient intake manifold assembly having a bifurcated zip tube for efficient delivery of combustion air to the engine.

BACKGROUND

With the increased focus on vehicle economy, particularly vehicle fuel economy, automotive manufacturers are turning to smaller, lighter vehicles and unique vehicle powertrains to boost efficiency. As vehicle packaging parameters become increasingly compact, the reduced size may require unique configurations of traditional engine components.

SUMMARY

In an exemplary embodiment an intake manifold assembly for mounting to a cylinder head and configured to deliver combustion air thereto comprises a centrally positioned zip tube having an opening for receipt of combustion air from a throttle body, first and second flow runners extending from the centrally positioned zip tube to terminate at a common intake manifold plenum for delivery of combustion air thereto, and a centrally located access opening defined between the first and second air flow runners.

In another exemplary embodiment, an intake manifold assembly for mounting to a cylinder head and configured to deliver combustion air thereto comprises a centrally positioned zip tube including having an opening for receipt of combustion air from a throttle body, first and second flow runners extending from the centrally positioned zip tube to terminate at axially remote ends of a common intake manifold plenum and a centrally located access opening defined between the second and third flow runners.

The above features and advantages, and other features and advantages of the present invention are readily apparent from the following detailed description of the invention when taken in connection with the accompanying drawings.

BRIEF DESCRIPTION OF THE DRAWINGS

Other objects, features, advantages and details appear, by way of example only, in the following detailed description of the embodiments, the detailed description referring to the drawings in which.

DESCRIPTION OF THE EMBODIMENTS

Figure 1:
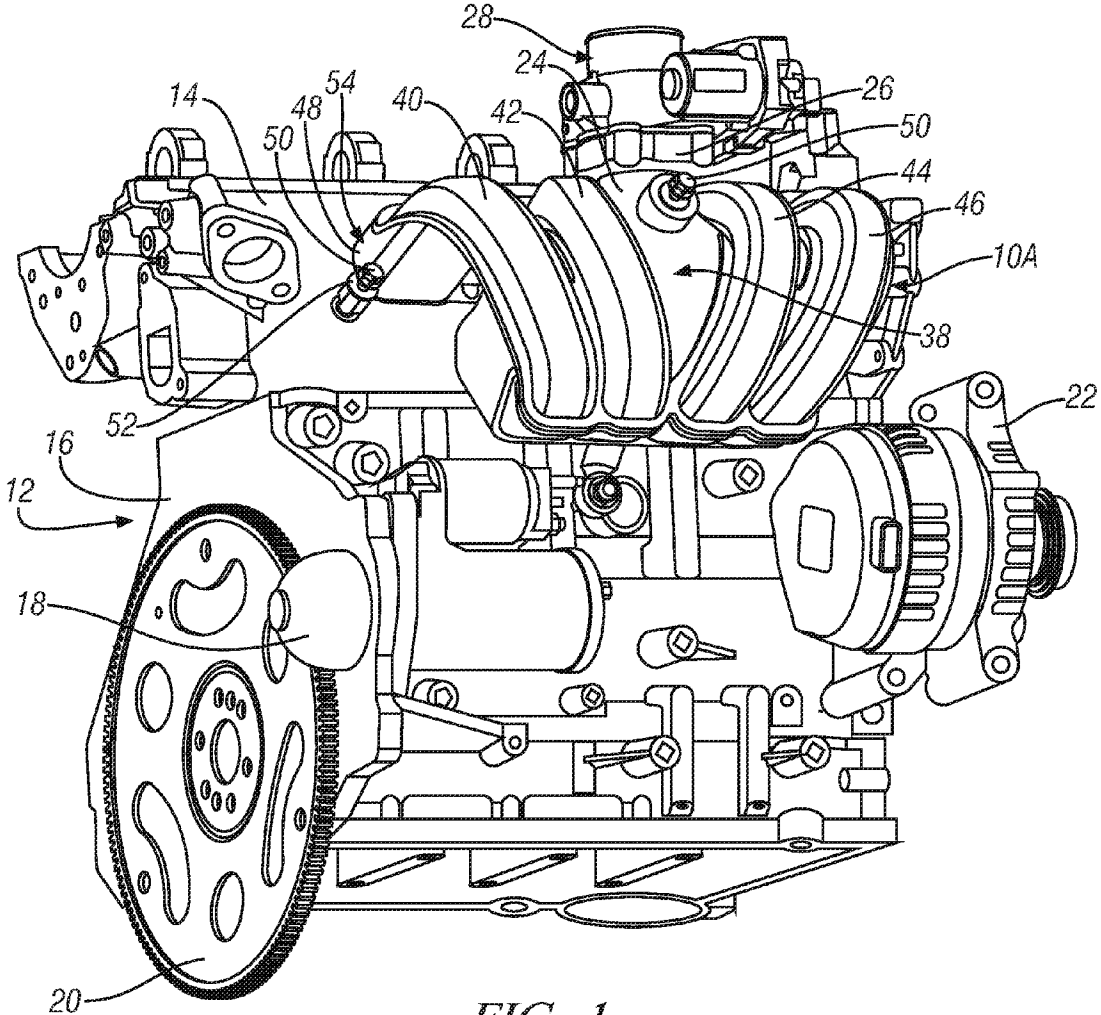
FIG. 1 is a perspective view of an internal combustion engine embodying features of the invention.

The following description is merely exemplary in nature and is not intended to limit the present disclosure, its application or uses. It should be understood that throughout the drawings, corresponding reference numerals indicate like or corresponding parts and features.

Referring now to FIG. 1, an exemplary embodiment of the invention is directed to an intake manifold assembly 10 that is configured to deliver combustion air to a cylinder head 14 of an internal combustion engine 12. The cylinder head 14 is mounted to a cylinder block 16 as are other components such as a rear mounted starter 18 that engages and rotates a toothed flywheel 20 during a starting mode, and a front mounted belt driven alternator 22.

The intake manifold assembly 10 includes a centrally positioned zip tube 24 having a mounting flange 26 that is configured to receive and support a throttle body 28 thereon. The centrally positioned mounting flange 26 includes an opening 30, FIG. 4, for receipt of metered combustion air flowing through the throttle body 28 from an air induction system (not shown). The throttle body is fixed to the mounting flange 26 by suitable fasteners such as bolts 32, FIG. 2.

Figure 2:
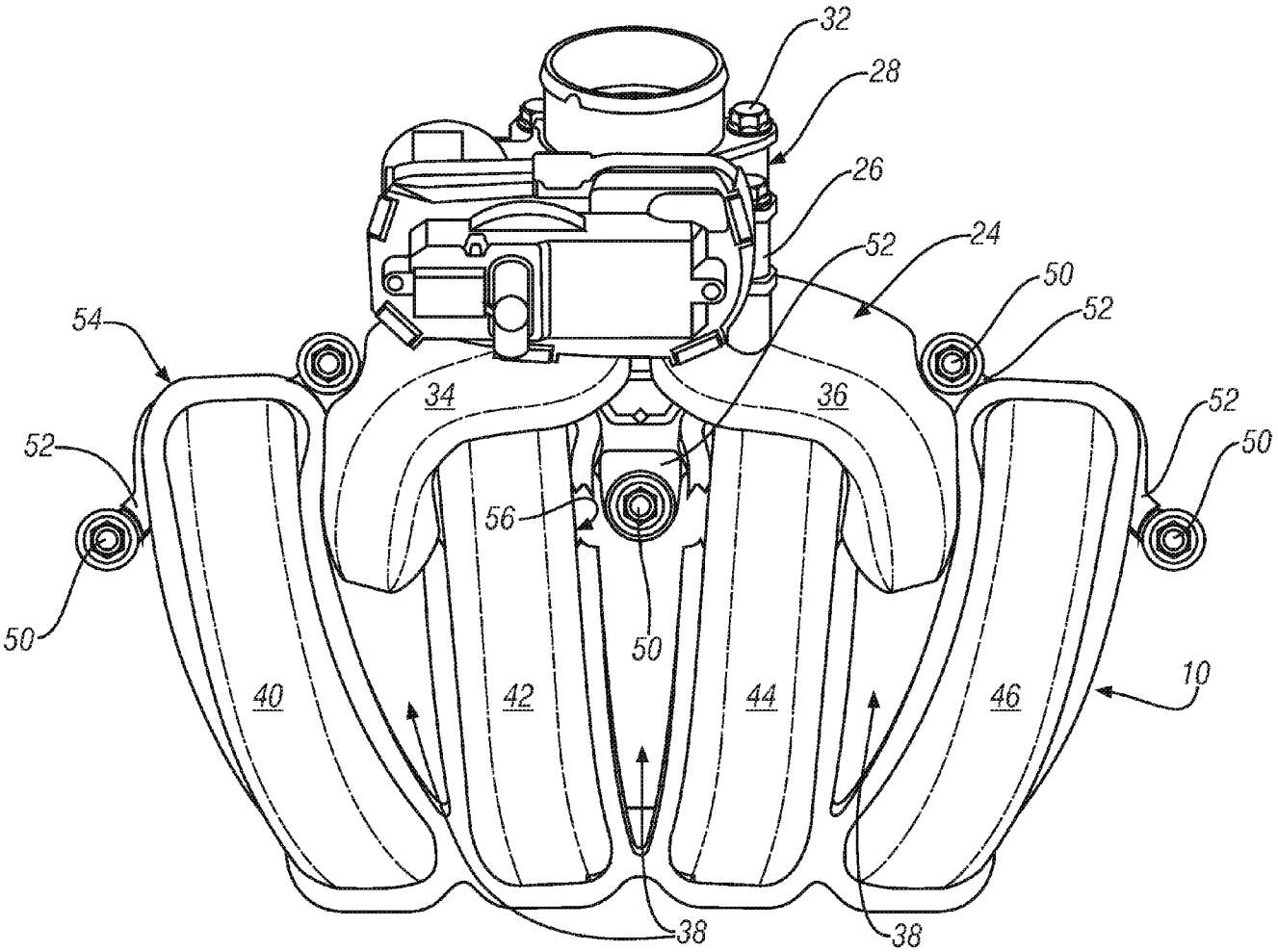
FIG. 2 is a top view of an intake manifold assembly for the engine of FIG. 1 embodying features of the invention.
Figure 5:
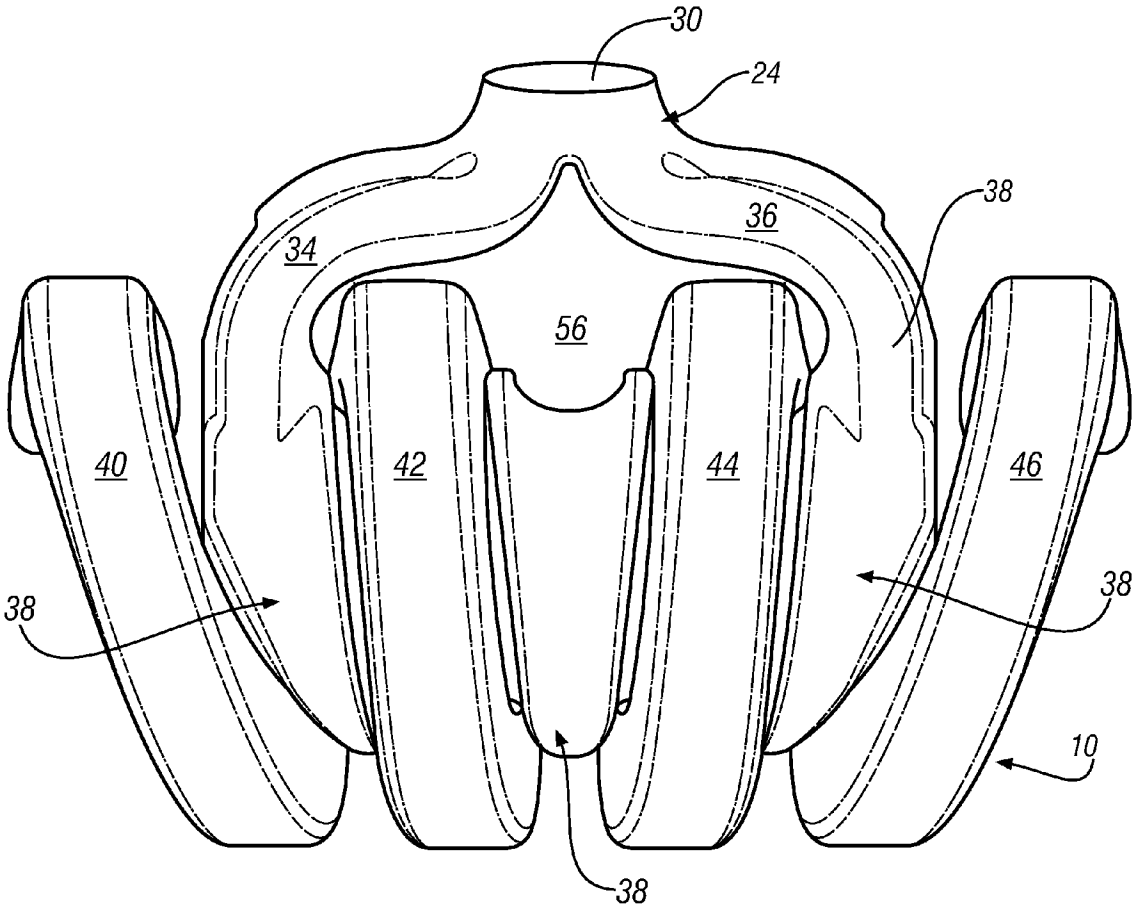
FIG. 5 is an air core diagram of the intake manifold assembly of FIG. 2.

In an exemplary embodiment shown in FIGS. 2 and 5, the centrally positioned zip tube 24 bifurcates into first and second air flow runners 34 and 36 below the mounting flange 26. The first and second air flow runners 34 and 36 extend axially along the intake manifold 10 and terminate at axially remote ends of a common intake manifold plenum 38 where the combustion air flowing through the throttle body 28 and into the zip tube 24 is delivered. The intake manifold plenum 38 is configured to distribute the combustion air delivered by each of the first and second air flow runners 34 and 36 to a plurality of intake runners, in this case first, second, third and fourth intake runners 40, 42, 44, 46 that extend axially along the length of and around the circumference of the common intake manifold plenum 38 to terminate at outlet ports 48, FIG. 1, which are fluidly and sealingly connected to inlet ports (not shown) of the cylinder head 14. In an exemplary embodiment, the first and second flow runners terminate between axially spaced intake runners. More specifically, in the embodiment of FIGS. 2 and 5, first air flow runner 34 extends between first and second intake runners 40 and 42 while second air flow runner 36 extends between third and fourth intake runners 44 and 46, respectively.

The intake manifold assembly 10 is connected to the cylinder head through the use of suitable fasteners such as bolts 50 that engage a sealing flange 52 attached to the outlet end 54 of the intake runners 40, 42, 44, 46. In the exemplary embodiment of FIGS. 2 and 5, to assure a leak free seal between outlet ports 48 of the intake runners 40, 42, 44, 46 with the cylinder head 14, it is important that a consistent sealing force be applied to the sealing flange 52 along its entire length. Bifurcation of the zip tube 24 into first and second air flow runners 34 and 36 provides a centrally located access opening 56 between the second and third intake runners 42 and 44 which would not otherwise be available if the zip tube 24 delivered combustion air to the center of the intake manifold plenum 38 in a conventional single tube manner. Through the access opening 56 a fastener such as bolt 50 is easily located and effective to provide a reliable seal between the intake manifold assembly 10 the sealing flange 52 and the cylinder head 14 of the internal combustion engine 12.

Figure 3:
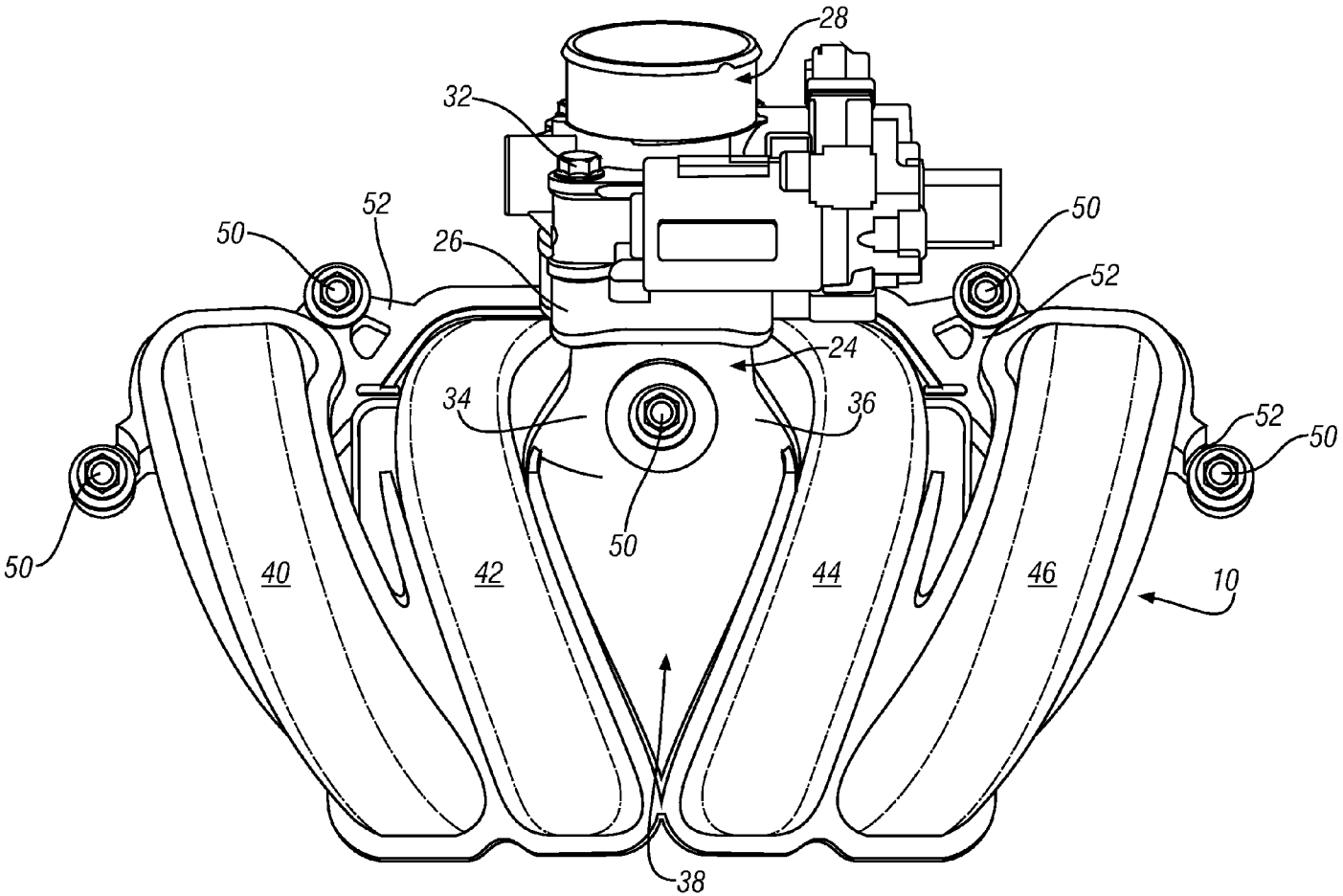
FIG. 3 is a top view of another embodiment of an intake manifold assembly for the engine of FIG. 1 embodying features of the invention.
Figure 4:
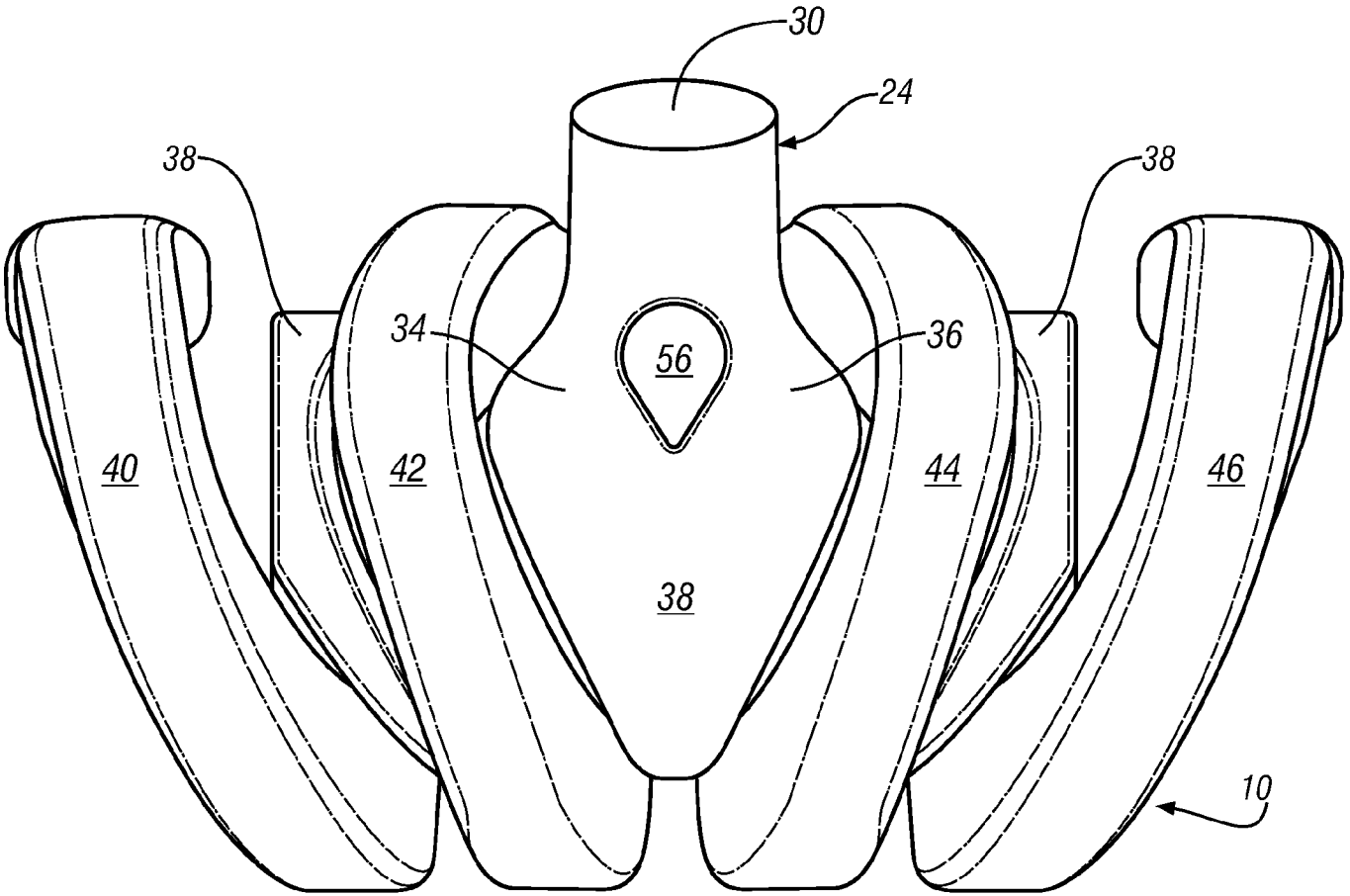
FIG. 4 is an air core diagram of the intake manifold assembly of FIG. 3.

Referring now to FIGS. 1, 3 and 4, in another exemplary embodiment, the intake manifold assembly 10 includes a centrally positioned zip tube 24 having a mounting flange 26 that is configured to receive and support a throttle body 28 thereon. The mounting flange 26 includes an opening 30, FIG. 4, for receipt of metered combustion air flowing through the throttle body 28 from an air induction system (not shown). The throttle body 28 is fixed to the mounting flange 26 by suitable fasteners such as bolts 32.

The centrally mounted zip tube 24 bifurcates into two air flow runners 34 and 36 below the mounting flange 26. Combustion air flowing through the zip tube 24 is divided into two separate flow paths and is delivered to a common intake manifold plenum 38. The common intake manifold plenum 38 is configured to distribute the combustion air delivered by each of the first and second air flow runners 34 and 36, respectively, to a plurality of intake runners, in this case first, second, third and fourth intake runners 40, 42, 44, 46 that extend axially along the length and around the circumference of the common intake manifold plenum 38 to terminate at outlet ports 48, FIG. 1, which are fluidly and sealingly connected to inlet ports (not shown) of the cylinder head 14. In this exemplary embodiment, both first and second air flow runners 34 and 36 extend between second and third intake runners 42 and 44 however, bifurcation of the zip tube 24 into air flow runners 34 and 36 provides a centrally located access opening 56 therebetween which would not otherwise be available if the zip tube 24 delivered combustion air to the center of the intake manifold plenum 38 as a single tube. Through the access opening a fastener such as bolt 50 is easily located and is effective to provide a reliable seal between the intake manifold assembly 10 and the cylinder head 14 of the internal combustion engine 12 FIGS. 1, 2 and 3.

While the invention has been disclosed in an intake manifold assembly 10 having four intake runners, it is contemplated that it may just as easily have application to manifold assemblies having, for instance, six intake runners as one might find on an in-line 6 cylinder engine. Other engine configurations are also contemplated.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. An intake manifold assembly for mounting to a cylinder head and configured to deliver combustion air thereto comprising:

a zip tube defining an opening at an inlet end for receipt of combustion air from a throttle body and for communication of the combustion air to a common intake manifold plenum;

a plurality of outlet ports disposed along a length of the intake manifold assembly for receiving combustion air from the common intake manifold plenum and delivering the combustion air to the cylinder head, the plurality of outlet ports form a sealing flange for mating the intake manifold assembly to the cylinder head; and a fastener for fastening the intake manifold assembly to the cylinder head;

said common intake manifold plenum defining a plenum longitudinal axis that is disposed along the length of the intake manifold assembly, the common intake manifold plenum defining axially remote ends that are disposed along the plenum longitudinal axis at opposing ends of the common intake manifold plenum;

the inlet end of said zip tube being positioned centrally along said longitudinal axis and bifurcating at an outlet end to define first and second air flow runners diverging from a central axis of the inlet end of the zip tube and terminating at axially remote ends of the common intake manifold plenum for delivery of combustion air thereto;

the first and second air flow runners defining a centrally located access opening between the first and second air flow runners so as to provide access to the fastener; and the fastener being disposed through the common intake manifold plenum between the first and second air flow runners for mechanically coupling the intake manifold assembly to the cylinder head and for causing the sealing flange to mate with the cylinder head with a consistent sealing force between the sealing flange and the cylinder head along the length of the intake manifold assembly so as to thereby provide a reliable seal between the intake manifold assembly and the cylinder head.

2. The intake manifold assembly of claim 1, further comprising:

a plurality of intake runners disposed along a length of, and around a circumference of, the common intake manifold plenum, the plurality of intake runners extending from the common intake manifold plenum to terminate at the plurality of outlet ports, each outlet port of the plurality of outlet ports being fluidly and sealingly connected to the cylinder head, wherein the first air flow runner and the second air flow runner each extend between a respective intake runner pair out of the plurality of intake runners.

3. The intake manifold assembly of claim 1;

wherein the plurality of outlet ports consists of a first outlet port, a second outlet port, a third outlet port, and a fourth outlet port respectively disposed along the length of the intake manifold assembly, the first outlet port being disposed at a first end of the mating flange, the fourth outlet port being disposed at a second end of the mating flange, the second outlet port being adjacent to the first outlet port and the third outlet port, and the third outlet port being adjacent to the second outlet port and the fourth outlet port;

wherein the inlet end of the zip tube is positioned between the second outlet port and the third outlet port;

wherein the first air flow runner terminates at the axially remote end of the common intake manifold plenum that is disposed between the first outlet port and the second outlet port; and wherein the second air flow runner terminates at the axially remote end of the common intake manifold plenum that is disposed between the fourth outlet port and the third outlet port.

4. An intake manifold assembly for mounting to a cylinder head and configured to deliver combustion air thereto comprising:

a zip tube defining an opening at an inlet end for receipt of combustion air from a throttle body and for communication of the combustion air to a common intake manifold plenum;

a plurality of outlet ports disposed along a length of the intake manifold assembly for receiving combustion air from the common intake manifold plenum and delivering the combustion air to the cylinder head, the plurality of outlet ports forming a sealing flange for mating the intake manifold assembly to the cylinder head; and a fastener for fastening the intake manifold assembly to the cylinder head;

said common intake manifold plenum defining a plenum longitudinal axis that is disposed along the length of the intake manifold assembly, the common intake manifold plenum defining axially remote ends that are disposed along the plenum longitudinal axis at opposing ends of the common intake manifold plenum;

the inlet end of said zip tube being positioned centrally along said longitudinal axis and bifurcating at an outlet end to define first and second flow runners diverging from a central axis of the inlet end of the zip tube and terminating at axially remote ends of the common intake manifold plenum for delivery of combustion air thereto;

the first and second air flow runners defining a centrally located access opening between the first and second flow runners so as to provide access to the fastener;

the fastener being disposed between the first and second air flow runners for mechanically coupling the intake manifold assembly to the cylinder head and for causing the sealing flange to mate with the cylinder head with a consistent sealing force between the sealing flange and the cylinder head along the length of the intake manifold assembly so as to thereby provide a reliable seal between the intake manifold assembly and the cylinder head.

5. The intake manifold assembly of claim 4, further comprising first, second, third and fourth intake runners fluidly connected to the common intake manifold plenum and configured to transport combustion air from the common intake manifold plenum to the cylinder head;

the first flow runners terminating between the first and second intake runners, and the second flow runner terminating between the third and fourth intake runners.

6. The intake manifold assembly of claim 5, the sealing flange being attached to an outlet end of the first, second, third and fourth intake runners; and the fastener located through said centrally located access opening to engage the intake manifold, the sealing flange and the cylinder head to define a compression seal therebetween.

7. The intake manifold assembly of claim 5, further comprising:

a plurality of intake runners fluidly connected to the common intake manifold plenum and configured to transport combustion air from the common intake manifold plenum to the cylinder head and having the first and second flow runners terminating between axially spaced intake runners.

8. The intake manifold assembly of claim 5, wherein said zip tube is disposed along in a zip tube axis that is disposed in a zip tube plane that is substantially perpendicular to said longitudinal axis.

9. The intake manifold of claim 5, wherein said zip tube plane is disposed so as to intersect said longitudinal axis at a point along said longitudinal axis between said second and third intake runners.

10. The intake manifold of claim 5, wherein said first and second air flow runners extend from said zip tube in opposite directions from one another along said longitudinal axis.

11. The intake manifold of claim 10:

wherein said first air flow runner extends from said zip tube in a first direction along said longitudinal axis;

wherein said second air flow runner extends from said zip tube in a second direction along said longitudinal axis; and wherein said first direction is in substantial opposition to said second direction.

12. The intake manifold of claim 5, wherein the longitudinal axis is disposed substantially parallel to a line intersecting said plurality of outlet ports.

13. The intake manifold of claim 5, wherein the first and second air flow runners extend axially along the common intake manifold plenum and terminate at axially remote ends of the common intake manifold plenum.

14. The intake manifold of claim 5, wherein the first and second air flow runners extend from the zip tube in a divergent manner.

* * * * *